US005979845A

United States Patent [19]

Battey et al.

[11] Patent Number: 5,979,845

[45] Date of Patent: Nov. 9, 1999

[54] HUB TUBE/WASHER ASSEMBLY

[75] Inventors: Robert J. Battey, Kentwood; John L. Hendricks, Grand Rapids; Charles L. Cartwright, Casnovia; Brian H. Root, Grandville, all of Mich.

[73] Assignee: Steelcase Inc., Caledonia, Mich.

[21] Appl. No.: 08/857,951

[22] Filed: May 16, 1997

[51] Int. Cl.[6] ..... F16M 11/00

[52] U.S. Cl. ..... 248/161

[58] Field of Search ..... 248/161, 159, 248/157, 911, 407, 411, 414, 558, 188.5; 297/344.12, 344.18, 344.19, 344.21

[56] References Cited

U.S. PATENT DOCUMENTS

| | | | |
|---|---|---|---|
| 1,399,464 | 12/1921 | Collier . | |
| 3,711,054 | 1/1973 | Bauer . | |
| 4,245,826 | 1/1981 | Wirges . | |
| 4,480,730 | 11/1984 | Koller et al. . | |
| 4,627,602 | 12/1986 | Sporck | 248/161 X |
| 4,720,068 | 1/1988 | Tornero | 248/161 |
| 4,756,496 | 7/1988 | Hosan et al. | 248/161 |
| 4,899,969 | 2/1990 | Bauer et al. | 248/161 |
| 4,913,268 | 4/1990 | Parker et al. . | |
| 4,969,619 | 11/1990 | Bauer et al. . | |
| 5,078,351 | 1/1992 | Gaultieri | 248/161 |
| 5,234,187 | 8/1993 | Teppo et al. | 248/161 |
| 5,353,898 | 10/1994 | Handke et al. . | |
| 5,377,942 | 1/1995 | Knopp et al. | 248/161 |
| 5,462,248 | 10/1995 | Bauer | 248/161 |
| 5,497,966 | 3/1996 | Fuhrmann | 248/161 |
| 5,511,759 | 4/1996 | DeKraker et al. | 248/161 |
| 5,702,083 | 12/1997 | Lai | 248/161 X |

*Primary Examiner*—Ramon O. Ramirez
*Attorney, Agent, or Firm*—Foley & Lardner

[57] ABSTRACT

An assembly for mounting the piston rod of a gas spring, such as may be used in adjustable-length chairs, stools, tables or the like, is disclosed. The hub tube used in the assembly is flared outwardly at its lower end to form a shoulder. The washer, to which the end of the piston rod is attached, is supported on the shoulder against movement into the tube. After the washer is placed against the shoulder, the end of the tube is rolled inwardly to contain the washer in the downward direction. The expanded area for support of the washer increases resistance to upward movement of the washer in response to the strong forces exerted by the gas spring. The expanded lower section of the tube also provides an area onto which the legs of the chair may be welded.

10 Claims, 2 Drawing Sheets

FIG. 2
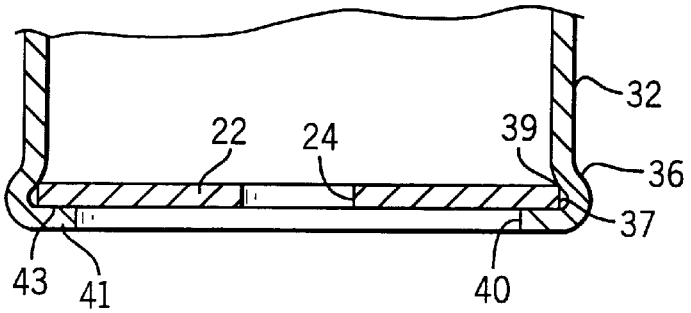
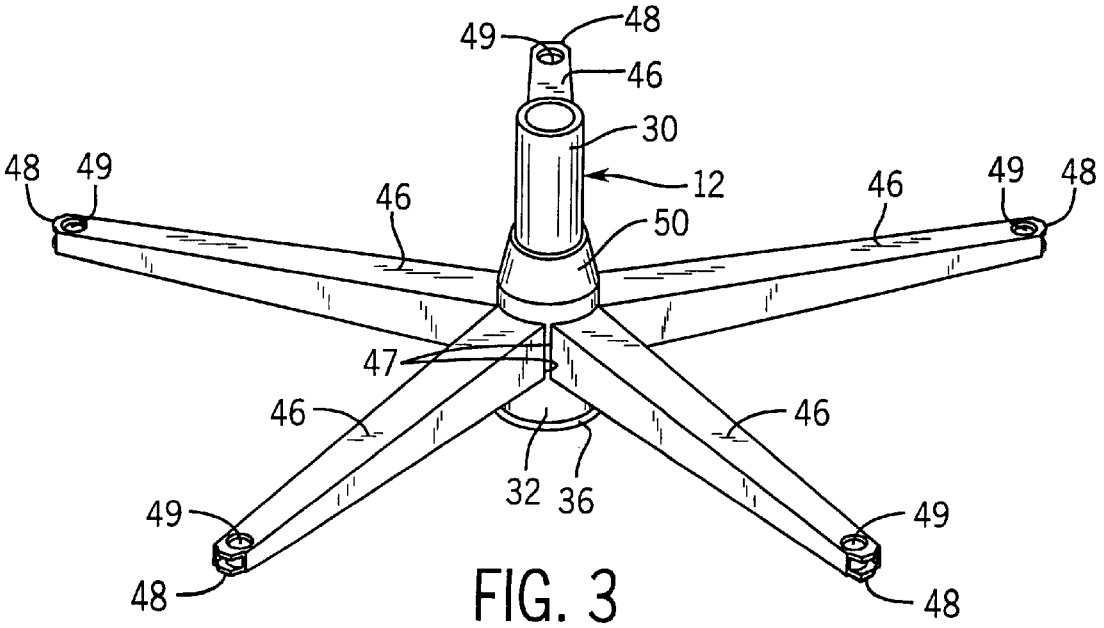
FIG. 3

HUB TUBE/WASHER ASSEMBLY

CROSS-REFERENCE TO RELATED APPLICATIONS, IF ANY

None.

BACKGROUND OF THE INVENTION

1. Field of the Invention

The present invention relates generally to the art of adjustable-length columns, such as those used with chairs, stools, tables and the like. More specifically, the present invention relates to a technique for mounting the washer plate to the hub tube, the plate in turn receiving the outer end of the piston rod of a gas spring. The technique facilitates assembly and increases the strength of the washer plate securement. Still more specifically, the present invention relates to securing a washer plate into the lower end of an expanded cross-section hub tube and providing an expanded surface area on the tube for attachment of the legs of the chair or table.

2. Description of the Prior Art

Adjustable-length columns for chairs, tables and the like have been known for many years. For example, Wirges U.S. Pat. No. 4,245,826 issued Jan. 20, 1981 for "Resilient Column Of Adjustable Length" discloses a column including a pneumatic spring of the piston-and-cylinder type. The piston rod of the cylinder extends downwardly and is affixed to a washer located at the lower end of the tube. Upward movement of the washer into the tube is prevented by an indentation just above the lower end. The washer is confined between the indentation and an inwardly directed flange created by rolling the end of the tube inwardly so that the end faces are substantially parallel to the axis of the tube. The upper end of the cylinder is appropriately mounted in a guide tube for sliding upward and downward movement with respect to the lower end of the tube, so that the height of chairs, chair seats, tables or the like can be adjusted.

U.S. Pat. No. 3,711,054 was issued Jan. 16, 1973 to Fritz Bauer for "Continuously Adjustable Lifting Devices". This early patent also discloses a technique for providing stepless height adjustment of the seat of a chair, stool or the like using a fluid spring. The end of the piston rod in this device is held in the lower tube by providing an inwardly flanged rim and a disc-shaped body of yieldably resilient material. The body is arranged between two metal washers to confine the body against the flange and prevent upward or downward movement of the end of the piston rod relative to the lower tube.

A wide variety of modifications of basic column design are disclosed in the prior art. For example, in Bauer, et al. U.S. Pat. No. 4,969,619 issued Nov. 13, 1990 for "Adjustable-Length Columns For Chairs, Tables Or The Like", the attachment technique for the washer is modified by rolling the end of the tube further, so that the end face points upwardly and in direct contact with the bottom of the washer. In this device, the washer is held in place against a plurality of indentations by the end face of the tube. It is suggested in the Bauer, et al. patent that such further rolling of the end of the tube provides additional strength when compared to the Wirges design.

Another technique for mounting chair seats to supports is shown in Collier U.S. Pat. No. 1,399,464 issued Dec. 6, 1921 and entitled "Chair Iron". In this design, the seat is held against the tube by a bead above and below the upper plate of the support, each of the beads extending outwardly from the generally cylindrical spindle.

Other patents which disclose various techniques for holding components of shock absorbing devices, including piston rods, are U.S. Pat. No. 4,913,268 issued Apr. 3, 1990 to Parker, et al. for "Weldless Automotive Shock Absorber"; U.S. Pat. No. 5,353,898 issued Oct. 11, 1994 to Handke, et al. for "Vibration Damper Unit"; and U.S. Pat. No. 4,480,730 issued Nov. 6, 1984 to Koller, et al. for "Shock Absorber Unit For Vehicles".

A relatively common technique still used for attaching the washer to the hub tube is a 360° MIG weld around the perimeter of the washer. While this technique has been found entirely suitable from a strength standpoint, the process is time consuming and expensive.

While some manufacturers have eliminated such welding by using the indentation techniques mentioned above, the shelf formed inwardly of the washer is quite small relative to the ID of the main body of the tube. This is especially true where indents, rather than an inwardly directed flange, are provided. Some current designs contain as few as six indents and, under relatively low loads, the washer can be pushed past them and into the tube.

Another aspect of the construction of seating devices using such adjustable-length columns is attaching legs to the tubes. In most cases, such attachment is provided by welding both the horizontal and vertical surfaces of the legs to the small hub tubes. This is due primarily to the relatively small O.D. of the lower end of the tube compared to the size of the inner ends of the legs.

A significant advance in this art would result from a simplified technique for attaching the washer to the lower end of the hub tube and facilitating attachment of chair legs to the tube of adjustable length columns by providing a larger outer surface for such tubes.

SUMMARY OF THE INVENTION

The present invention features a hub tube washer assembly for use in length-adjustable columns for chairs, stools, tables and the like in which the washer is larger in diameter than the inside diameter of the body of the hub tube to provide increased resistance against movement of the washer into the tube under the high loads created by the gas spring.

Another feature of the present invention is a method for assembling a washer to a hub tube which is fast, reliable and inexpensive and which eliminates the need to weld the washer to the hub tube end.

A further feature of the present invention is to provide a larger diameter hub tube for receiving the inner ends of legs used for the chairs, stools, and the like, and in which the leg ends may be more simply welded to the hub tube.

A still further feature of the present invention is to provide a hub tube washer assembly which is readily adaptable to various gas cylinder sizes through selection of appropriate guide tubes.

How these and other features of the present invention are accomplished will be described in the following Detailed Description of the Preferred Embodiment, taken in conjunction with the FIGURES. Generally, however, they are accomplished by flaring the lower end of a hub tube outwardly to form a shoulder. The washer is larger than the inside diameter of the tube itself and rests on the shoulder. The lower end of the tube is rolled inwardly to confine the washer between the end and the shoulder, whereby movement of the washer is resisted in either direction. The larger washer, combined with the circumferential surface of the shoulder, provides increased resistance to upward movement of the washer compared to earlier designs where such upward movement was resisted by indentations and smaller sized washer. The features are also provided by a hub tube which, in some embodiments, is of increased size so that the inner, conforming ends of legs for chairs, stools, tables and the like may be more simply welded thereto, thus eliminating certain welding in prior processes.

Other ways in which the features of the present invention are accomplished will become apparent to those skilled in the art after they read the balance of this specification, and such other ways are deemed to fall within the scope of this invention, especially if they fall within the scope of the claims which follow.

DETAILED DESCRIPTION OF THE DRAWINGS

FIG. 2 is an enlarged, partial cross-sectional view of the device shown in FIG. 1 to more clearly illustrate a primary feature of the present invention; and FIG. 3 is a perspective view showing five legs attached to the hub tube illustrated in FIG. 1.

In the various FIGURES, like reference numerals are used to indicate like components.

DETAILED DESCRIPTION OF THE PREFERRED EMBODIMENT

Figure 1:
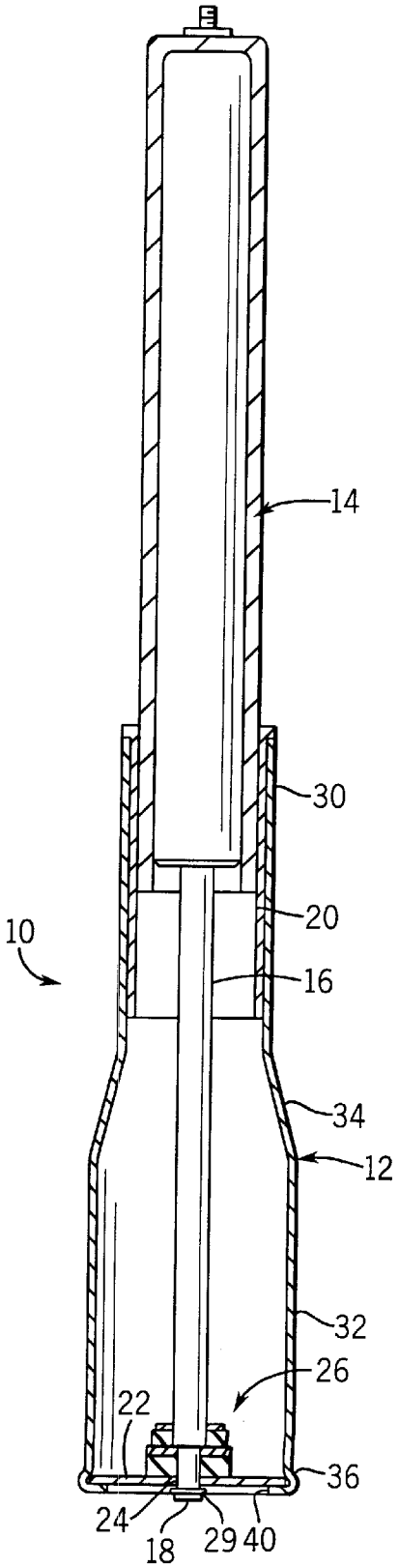
FIG. 1 is a vertical, cross-sectional view of a hub tube/washer assembly according to the preferred embodiment of the present invention and also showing in general form a length adjustable cylinder used therewith.

Before proceeding to the detailed description of the preferred and illustrated embodiments, several comments are warranted about the applicability and the scope of the present invention.

First, the following description does not describe in detail the various types of length adjustable cylinders and controls therefor which may be utilized with a hub tube and washer assembly made according to the present invention. A very large variety of such cylinders and controls are known, and many of them would be entirely suitable for use herein. Any of such cylinders which include a piston rod to be mounted to the lower end of a hub tube would be useful with the present invention, without regard to the cylinder components themselves, the way in which movement of the cylinder with respect to the end of the piston rod is carried out, the system used to mount the cylinder within the upper end of the hub tube (such as by use of well known guide tubes) and without regard to the way such cylinders are locked against length adjustment, or, in fact, the way such cylinders are attached to the chair, stool or table with which they will be used.

Second, the particular attachment technique for locking the end of the piston rod to the washer used in the present invention can be widely varied and can be selected from any of the many systems shown in the art. Some of such systems include deformable connectors, while others include bearings. Still others simply involve locking the outer end of the piston rod to the washer with snap rings, pins and the like. All of such techniques can be employed with the present invention.

Third, the illustrated embodiment of the present invention shows an expanded diameter, cylindrical body for the hub tube, which expanded diameter permits a more simple attachment of the legs to the hub tubes. The combination of the cylinder tube body and the washer attachment system represents an alternate embodiment of the invention.

Fourth, the present specification does not describe in full detail all the materials or the dimensions for the various tube, washer, weld or leg components. That is because they do not, in and of themselves, form part of the present invention. Accordingly, those skilled in the art may readily select materials and dimensions as appropriate from design, cost, safety and manufacturing standpoints without departing from the spirit and scope of the present invention.

Referring now to FIG. 1, a hub tube washer assembly 10 according to the present invention is shown to include a generally cylindrical body 12 and a gas cylinder shown generally at 14. Cylinder 14 includes a piston rod 16 having a free end 18. The free end is located beneath cylinder 14 and the piston rod extends generally downwardly with its axis aligned with that of body 12. A guide tube 20 is located in the upper portion of body 12, the gas cylinder 14 sliding therethrough as is generally known in the art.

The hub tube washer assembly of the present invention further includes a washer plate 22 having a central opening 24. Axial bearings 26 are shown surrounding piston rod 16 inwardly of washer plate 22, the bearing assembly also being generally known to the art. A shim plate 27 is located in an annular groove 29 at the end of piston rod 16 to confine the free end of the piston rod just exteriorly of the washer plate 22.

In the present invention, body 12 includes three sections, including an upper, generally narrower upper cylindrical section 30 having an ID sized to receive the guide tube 20. A larger, lower portion 32 has a greater cross-sectional area and an inner and outer diameter significantly larger than that of upper section 30. A generally smooth flared section 34, is provided between areas 30 and 32.

A further flared section 36 is provided adjacent the lower end of section 32, resulting in a shoulder 39, while the end of tube 12 is shown in FIG. 1 to be rolled inwardly approximately 900 as designated at reference numeral 40. The rolling of the tube 12 can be accomplished using well-known equipment, such as a mechanical press. Note the in FIG. 1 and in FIG. 2 that the washer plate 22 is confined between shoulder 39 and the horizontal portion 40 of the lower end of body 12 and that it is the upper corners of the washer plate that makes contact with shoulder 39. This is the preferred arrangement. It is apparent from these two FIGURES that the diameter of the washer 22 is greater than the inside diameter of section 32. It is further apparent from FIG. 2 that no welding or other fastening technique is required for securing washer 22 firmly in place, because it is confined as described.

It is also apparent from FIGS. 1 and 2 that the physical support for washer 22 extends around a substantially larger area than was available in the prior art where indentations in a hub tube or an annular rolled area extending inwardly toward the axis were used. Moreover, forces are still maintained in an axial direction.

As indicated in the introduction to the description of the preferred embodiment, the body 12 could be cylindrical except for flare 36 and the other components shown in detail in FIG. 2. For example, the hub tube could have a diameter equivalent to that of section 32 through its upper end, in which case larger gas cylinders could be used or a larger guide tube could be used for the gas cylinder.

FIG. 3 illustrates another feature of the invention utilizing the hub tube body 12 shown in FIGS. 1 and 2. The gas cylinder has been omitted for purposes of illustration. The upper section 30 and lower section 32 of the body 12 are readily apparent from this FIGURE, as are five legs 46, which themselves include inner ends 47, outer ends 48 and caster receiving bosses 49. The inner ends 42 are directly attached, such as by welding, to the tube section 32. Because of its increased size, the area for contact is larger and hence the welding operation is easier. A cover 50 is provided around flared section 34 of body 12, primarily for aesthetic purposes.

While the present invention has been described above in connection with a single preferred embodiment and an alternate embodiment, the invention is not to be limited thereby but is to be limited solely by the scope of the claims which follow, as one skilled in the art will appreciate numerous modifications once the entire specification has been read and understood.

What is claimed is:

1. A length-adjustable column for chairs, stools, tables and similar furniture applications comprising:

a hub tube having a first end, a second end and a generally cylindrical body having an axis;

a length-adjustable fluid cylinder mounted in the body for movement with respect thereto and having a piston rod extending therefrom, the piston rod having an outer end and an axis coinciding with the axis of the body, the outer end located in proximity to the second end of the tube;

the body having a first inside diameter along a first substantial portion of its length extending from the first end and a second inside diameter greater than the first inside diameter along a minor portion of its length extending from the second end, and an outwardly flared shoulder adjacent the second end and between the first substantial and minor portions of the body; and a generally circular plate having a diameter less than the second inside diameter and greater than the first inside diameter, the plate lying in said tube and oriented transversely with respect thereto, the outer end of the piston rod being fastened to the plate and the second end of the tube being rolled inwardly to confine the plate against the flared shoulder.

2. The column of claim 1 wherein the plate includes a central hole and wherein the piston rod penetrates the hole.

3. The column of claim 1 wherein the flared shoulder is located adjacent the second end whereby the minor portion has a length only slightly greater than the thickness of the plate.

4. The column of claim 1 wherein a guide tube is located within the first portion of the body for slidably receiving the fluid cylinder therethrough.

5. The column of claim 1 wherein the body has a third inside diameter greater than the first inside diameter and less than the second inside diameter along a second substantial portion of its length, the second substantial portion located between the first substantial portion and the minor portion, a flared portion located intermediate the first and second substantial portions, the washer plate having a diameter greater than the third inside diameter.

6. A base for a chair, table, stool or the like having seat height adjustment capability comprising:

a hub tube having a generally cylindrical body having an axis and an upper end and a lower end, a length-adjustable, fluid cylinder slidably mounted within the tube and having a piston rod extending downwardly therefrom, the rod having a free end located in proximity with the lower end of the tube and an axis coinciding with the tube axis;

the lower end of the tube being flared outwardly forming a shoulder having a diameter;

a circular plate coupled to the free end of the rod and having a diameter exceeding that of the tube body but being less than the diameter of the shoulder, the lower end of the tube being rolled inwardly to confine the plate between the lower end and the shoulder; and the base having a plurality of legs extending radially outwardly from the tube, the legs each having an inner end conforming to the outer surface of the tube, the inner ends of the legs being securely fastened to the tube but not to each other.

7. The base of claim 6 wherein the upper end of the tube has a constricted, generally cylindrical portion and wherein the cylinder is slidably confined within the constricted portion.

8. The base of claim 6 wherein a generally cylindrical guide tube is received within the hub tube for slidably confining the cylinder.

9. The base of claim 6 wherein the plate is a washer plate having a central opening therein and wherein the rod end penetrates the opening.

10. The base of claim 6 wherein the inner ends of the legs are welded to the tube.

* * * * *